US006640339B1

(12) United States Patent
Gilligan

(10) Patent No.: US 6,640,339 B1
(45) Date of Patent: Nov. 4, 2003

(54) BASEBALL MITT

(75) Inventor: Lawrence J. Gilligan, Ringwood, NJ (US)

(73) Assignee: Akadema, Inc., Garfield, NJ (US)

( * ) Notice: Subject to any disclaimer, the term of this patent is extended or adjusted under 35 U.S.C. 154(b) by 0 days.

(21) Appl. No.: 10/191,713

(22) Filed: Jul. 9, 2002

(51) Int. Cl.[7] ..... A41D 13/10
(52) U.S. Cl. ..... 2/19
(58) Field of Search ..... 2/19, 16, 20, 158, 2/159, 161.1, 910, 917

(56) References Cited

U.S. PATENT DOCUMENTS

| | | | | | |
|---|---|---|---|---|---|
| 2,288,467 | A | * | 6/1942 | Latina | 2/19 |
| 2,459,887 | A | * | 1/1949 | Latina | 2/19 |
| 2,558,544 | A | | 6/1951 | Delsalle | |
| 2,625,686 | A | | 1/1953 | Latina | |
| 2,736,028 | A | * | 2/1956 | Sternlicht | 2/19 |
| 3,051,958 | A | | 9/1962 | Latina | |
| 3,098,234 | A | | 7/1963 | Latina | |
| 3,169,250 | A | | 2/1965 | Heiman | |
| 3,300,787 | A | | 1/1967 | Denkert | |
| 4,279,681 | A | | 7/1981 | Klimezky | |
| 4,346,481 | A | | 8/1982 | Latina | |
| 4,461,043 | A | | 7/1984 | Lomedico | |
| 4,630,318 | A | | 12/1986 | Aoki | |
| 4,847,915 | A | | 7/1989 | Keene | |
| 4,853,975 | A | * | 8/1989 | Clevenhagen | 2/19 |
| 4,987,611 | A | | 1/1991 | Maye | |
| 5,168,578 | A | | 12/1992 | Stanley | |
| 5,285,529 | A | * | 2/1994 | Arena | 2/20 |
| 5,379,459 | A | | 1/1995 | Williams, Jr. | |
| 5,572,739 | A | | 11/1996 | Kolada et al. | |
| 5,604,934 | A | | 2/1997 | Willett | |
| 5,678,245 | A | | 10/1997 | Rector et al. | |
| 5,687,421 | A | | 11/1997 | Murai | |
| 5,694,641 | A | | 12/1997 | Doi et al. | |
| 5,706,519 | A | | 1/1998 | Cooper | |
| 5,937,444 | A | * | 8/1999 | Hochmuth | 2/161.1 |
| 6,041,438 | A | | 3/2000 | Kirkwood | |
| 6,154,882 | A | | 12/2000 | Ullman | |
| 6,253,382 | B1 | | 7/2001 | Kleinert | |
| 6,260,198 | B1 | | 7/2001 | LoMedico | |
| 6,289,515 | B1 | | 9/2001 | Fous | |
| 6,292,946 | B1 | * | 9/2001 | Angione | 2/20 |

* cited by examiner

*Primary Examiner*—Gary L. Welch
(74) *Attorney, Agent, or Firm*—Michael R. Gilman; Kaplan & Gilman, LLP

(57) ABSTRACT

A baseball mitt having a construction such that the mitt's front and back shells, internal padding member(s), and its web-type panel, create four peripheral padding zones. Two of the peripheral padding zones closest to, and on either side of, the web-type panel, are greater in thickness then the thickness of the mitt at the pocket, but are smaller in thickness then the thickness of the other two peripheral padding zones that extend down toward the heel of the mitt. The mitt further has a double-hinge assembly to facilitate easier folding of the mitt around a caught baseball. The mitt also has at least one extra finger hammock for securing at least two fingers and a thumb of the user of the mitt. In addition, the mitt has a stress wedge located so as to protect the soft web portion of a user's hand located between the index finger and thumb of the user's hand, along with the remaining palm of the user's hand.

43 Claims, 7 Drawing Sheets

BASEBALL MITT

BACKGROUND OF THE INVENTION

This invention relates to the field of baseball gloves, and more particularly, to baseball catcher's mitts that are designed to facilitate better control and ease of use by the catcher using the glove.

Baseball gloves and catcher's mitts, are as old as the game itself. Yet many improvements have been made in baseball gloves over these many years as the game itself has become both quicker and harder to play due to technological advances in the construction of both baseballs and baseball bats, and also due to the higher level of fitness, strength and size of today's baseball players. In order to keep up with these subtle, yet ever present, changes in the way the game is played, baseball gloves and catcher's mitts have also needed to evolve.

Some obvious changes that have come to pass over the years in the design and construction of baseball gloves for professional baseball center around the change of design between a catcher's mitt and the gloves worn by the rest of the players. As the game developed and became more popular and a realization of the specialty characteristics of the catcher position became more evident, the mitts for this position also adapted and changed more rapidly than for other positions. In particular, as most people know today, a catcher's mitt is far different in shape, composition and purpose, than are the gloves of any of the other positions on the field because the catcher is usually required to field balls that are traveling at much higher velocities than are balls traveling to other positions on the field.

The subject invention is directed to a catcher's mitt to be used in a high level of play; such as by high school, collegiate and/or professional players. In particular, the subject catcher's mitt is designed to have less padding then the catcher's mitts known to exist in the prior art, thereby reducing the protrusions and angles that cause a baseball to irregularly bounce off of the catching surface of the mitt, and so assist the catcher to field the baseball more cleanly, more often. Further, and in association with the reduced padding improvement, the subject invention has the further improvement of a double hinge assembly at a heel portion of the mitt. Such a double hinge assembly creates a more highly flexible catcher's mitt, which facilitates a faster and stronger "trapping" of the ball securely within the pocket of the mitt after it is caught by the catcher. Even further, the catcher's mitt of the subject invention uses an advanced padding element, called a stress wedge hereinafter, that helps to cushion the impact of the ball against the softest part of a person's hand; the web portion of a person's hand located between the index finger and thumb. Finally, the catcher's mitt of the subject invention incorporates extra finger hammocks; above and beyond the one finger hammock found in prior art mitts and gloves.

Over the years, other catcher's mitts have been designed to reduce the padding along certain portions of the mitt. However, these prior art mitts have failed to fully develop this construction, and have, therefore, left more padding then is required. Further, over the years, other gloves/mitts have been designed to be more flexible, and whether they have achieved this result or not is not known (but is considered irrelevant), as their construction is significantly different than the construction of the subject baseball mitt invention.

U.S. Pat. No. 4,346,481, issued in 1982 to Latina, and is directed to a baseball mitt, and in particular a catcher's mitt designed to be more flexible due to the positioning of a glove 11 secured to the back of the mitt body 5. Essentially, the '481 patent discloses that glove 11 is oriented on the back of mitt 1, in such a way that the normal mechanical opening of a person's hand is more directly aligned with the single hinge-line 31 of the mitt. The '481 mitt also shows a reduced padding element extending along the periphery of the mitt, but on only one side of the webbing; i.e., on the finger portion side of the mitt, not on the thumb portion side. Accordingly, the '481 patent differs from the subject invention in both the number of reduced padding elements and the number of hinge assemblies along the hinge of the mitt.

U.S. Pat. No. 5,678,245, issued in 1997 to Rector et al., for a flexible baseball glove. However, as with the above '481 patent, it is seen in the '245 patent that thinned out padding is only found on the finger side of the mitt and that the hinge at the heel is only a single hinge assembly, not a double hinge assembly like that of the subject invention.

U.S. Pat. No. 5,687,421, also issued in 1997, this time to Murai, for protecting covers for baseball mitts and gloves. The same single thin pad and single hinge assembly arguments are available to distinguish this patented devise over that of the subject invention.

U.S. Pat. No. 4,847,915, issued in 1989 to Keene, for a baseball glove with a flexible heel construction. Here also, while the '915 patent discusses a more flexible glove, this is where the similarities to the subject invention end. The '915 patent specifically discusses achieving a flexibility in the heel portion of the glove for use by children and young adults, while also discussing a single hinge-line 59 for the glove.

U.S. Pat. No. 5,694,641, issued in 1997 to Doi et. al., for a flexing baseball glove. The '641 patent shows the cooperation between a hole 8 located along the hinge-line of the glove and the extension portion 4, to allow for the increased flexibility of the glove. The subject invention has no such hole or extension portion to assist in its flexibility.

U.S. Pat. No. 4,987,611, issued in 1991 to Maye, for a protective padding device for baseball players' hands. While the Maye pad invention acts to protect the same area of the ball player's hand as the stress wedge of the subject invention, it is distinguishable from the subject invention in its manner of construction and application to the mitt/hand of the user.

It would be desirable to achieve a less obstructed catching surface for a catcher's mitt by reducing even further than the prior art, the padding immediately adjacent to the web portion of the mitt, while it would also be desirable to achieve more flexibility in a catcher's mitt at the heel portion thereof, so as to better assist the user of the mitt in closing the mitt around a caught baseball. It would also be desirable to have increased padding to protect the web portion of a person's hand between the index finger and the thumb, without the need of having to keep track of a separate, glove-like, pad to be worn over the person's hand. Finally, it would also be desirable for a catcher's mitt to use additional finger hammocks, in order to assist the player in the positioning of his fingers away from the front, impact surface of the mitt.

SUMMARY OF THE INVENTION

In accordance with the invention, an improved baseball catcher's mitt is provided. The mitt comprises front and back shells, joined together both along the periphery of the shells and selectively at internal portions of the mitt, and a web-type panel extending from the front and back shells, and being joined to the front and back shells along select portions of the panel and the shells. The web-type panel and a substantially centrally located portion of the front shell define a baseball receiving pocket. The mitt has at least one padding member disposed internally, between the front and back shells. The formation of the shells and the padding member create four peripheral, padding zones. Two of these peripheral padding zones closest to, and on either side of, the web-type panel, are greater in thickness then the thickness of the mitt at the pocket, but are smaller in thickness then a thickness of the other two peripheral padding zones that extend down toward the heel of the mitt. The mitt further has a double-hinge assembly at the heel of the mitt, for facilitating easier folding of the glove around a baseball received into the pocket. The mitt also has at least one extra finger hammock, for securing at least two fingers, and a thumb, of the user of the mitt, away from the front, catching surface of the mitt. In addition, the mitt has a stress wedge located so as to protect the soft web portion of a user's hand, located between the index finger and thumb of the user's hand.

Accordingly, it is an object of the invention to provide an improved baseball catcher's mitt.

Still another object of the invention is to provide an improved baseball catcher's mitt that has less padding along its periphery, to either side of the web-type panel, in order to reduce the large lumps and bulges of the contour of the mitt's periphery, and thereby reduce the likelihood of a ball deflecting out of the mitt on impact.

Still a further object of the invention is to provide an improved baseball catcher's mitt that is more flexible in its use.

Yet another object of the invention is to provide an improved baseball catcher's mitt having extra finger hammocks.

Still a further object of the invention is to provide an improved baseball catcher's mitt having two hinge assemblies along the heel of the glove, instead of the normally found single hinge assembly.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENTS

Referring to the figures, a baseball catchers mitt made in accordance with the subject invention is shown at 10. Mitt 10 has a front shell 20 and aback shell 30. As is ordinary and customary in the baseball mitt industry, front shell 20 is joined to back shell 30 in various locations along the shells' peripheries and internally, away from the various peripheral edges of the shells, by lacing 35 and 37. It is to be understood that other lacing, and even stitching, might be found on mitt 10, but are not shown in the figures, and that only representative lacing is actually shown.

Figure 1:
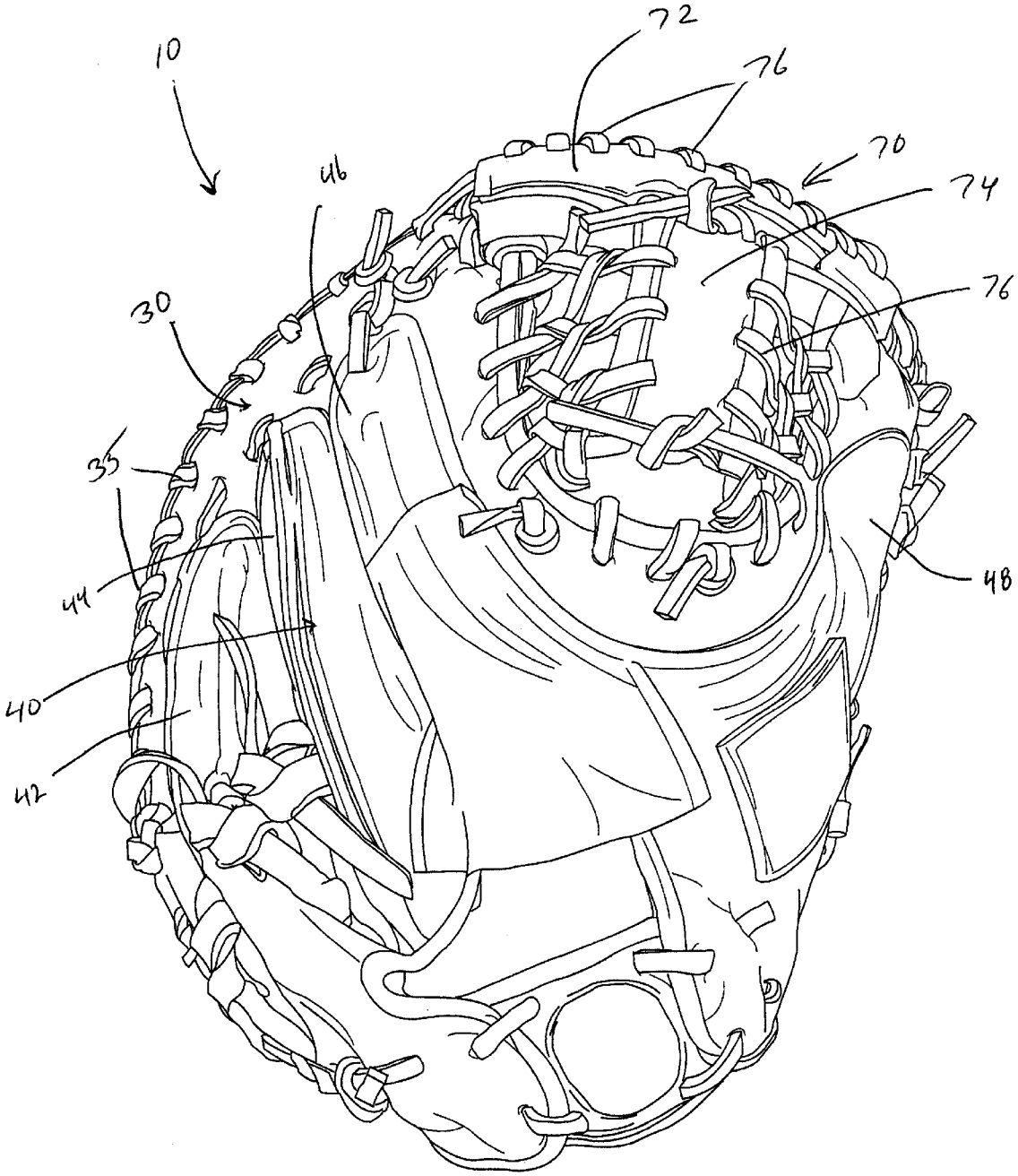
FIG. 1 is a rear elevational view of the baseball catcher's mitt of the subject invention.

As is best seen in FIG. 1, mitt 10 also has a hand receiving member 40 attached to a back surface of back shell 30. Hand receiving assembly 40 has the essential shape of a person's hand, comprising both finger stalls and a thumb stall for receipt therein of the fingers and thumb of the hand of the person using the mitt, as best seen in FIG. 3.

While hand receiving assembly 40 may have finger stalls for all four fingers of the person's hand (and the thumb stall for the person's thumb), it may also simply have one stall for all four fingers, or any combination thereof. As is seen in FIG. 1, in the preferred embodiment, hand receiving assembly 40 has three finger stalls, stalls 42, 44 and 46, and one thumb stall 48. As is seen in FIG. 3, the person's pinky and ring fingers are received within stall 42, while the middle finger is received within stall 44 and the index finger is received within stall 46.

Figure 3:
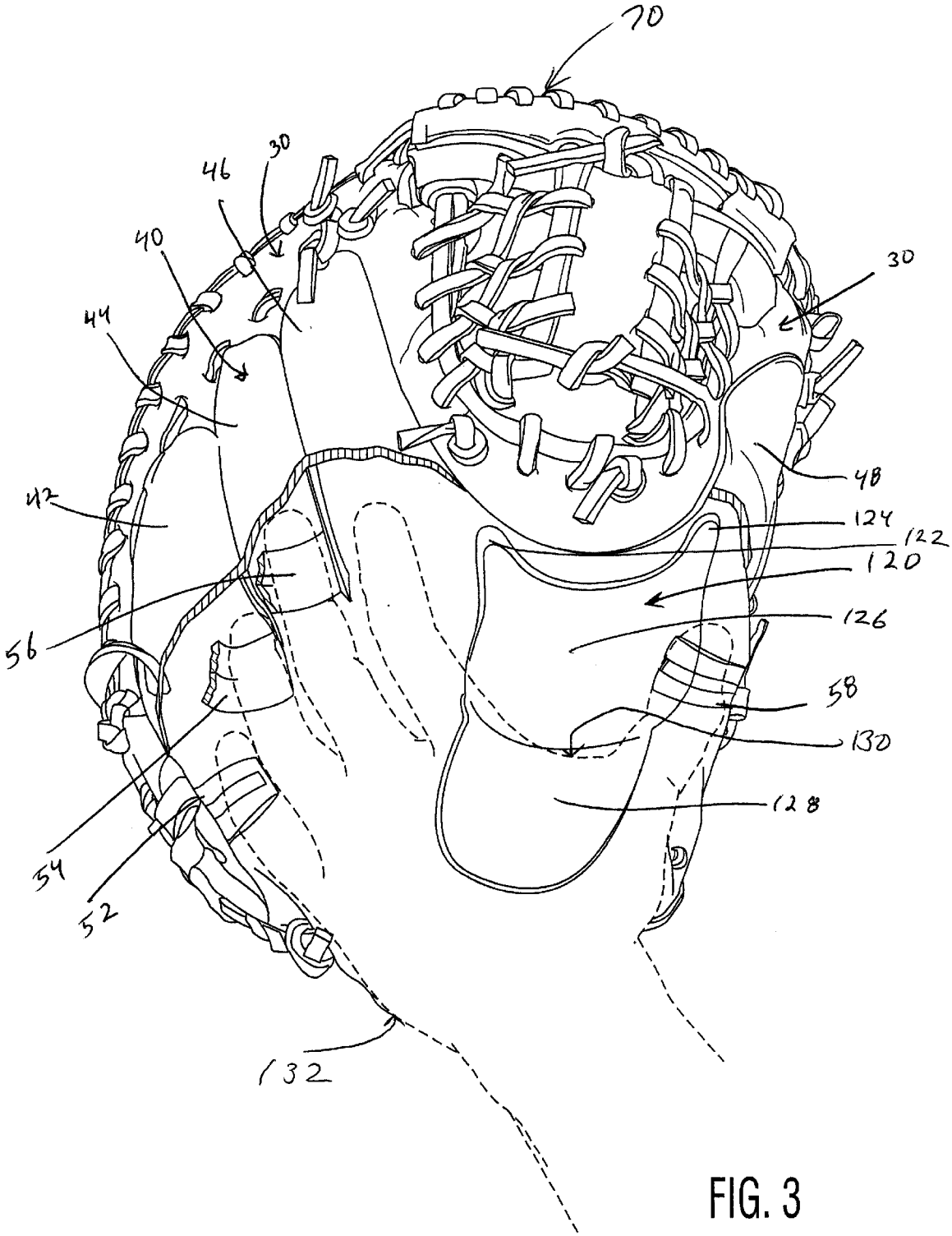
FIG. 3 is a rear elevational view of the baseball catcher's mitt of the subject invention, showing in the cutout the extra finger hammocks and in phantom, the hand of a user of the mitt.

Continuing, it is seen in FIG. 3 that within stalls 42 and 44 are finger hammocks 52, 54 and 56. One thumb hammock 58 is located in stall 48. As is known in the art of baseball gloves/mitts, a finger hammock is used to secure the players finger more closely to the back shell of the glove/mitt, as opposed to being disposed closer to the front shell, where the ball is received into the glove/mitt. However, never has a prior art glove/mitt had more than one finger hammock (for the pinky finger) and one thumb hammock. Accordingly, one of the improvements of the subject invention is that it has finger hammocks for additional fingers, with the preferred embodiment showing additional finger hammocks 54 and 56 for the ring and middle fingers of the person's hand, respectively.

Hand receiving assembly 40 is attached to the back surface of back shell 30 through standard, known stitching methods, but any other known and/or as yet unknown manner of attaching such an assembly to the back of a baseball glove/mitt is anticipated herein.

Figure 2:
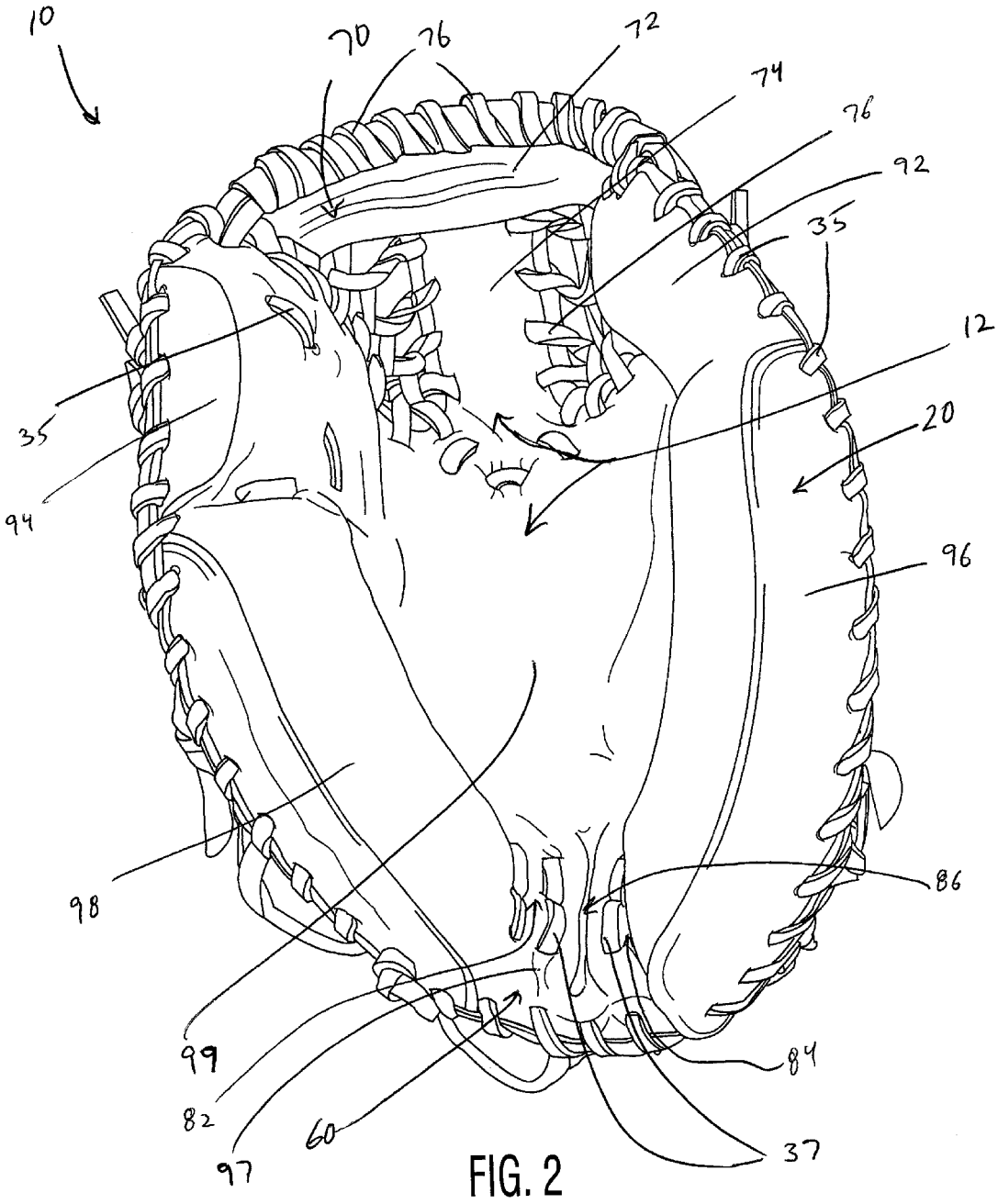
FIG. 2 is a front elevational view of the baseball catcher's mitt of the subject invention, showing the indent at the heel portion of the mitt dividing the double hinge assembly.

As is also seen in FIGS. 1 and 2, mitt 10 has a web-type panel 70. Web-type panel 70 preferably consists of first and second elements 72 and 74, stitched together in such a way as to form the shape of the letter "T". As is best seen in FIG. 1, this "T"-shaped element is secured to mitt 10 between what can best be described as the finger side of mitt 10 and the thumb side of mitt 10 at an area furthest away from a heel portion 60 of mitt 10, through use of lacing 76. It is to be understood that the subject invention can incorporate any form of web-type panel 70 that may already be known and used in the baseball trade, or that may not be presently known or used, but is created in the future.

Figure 4:
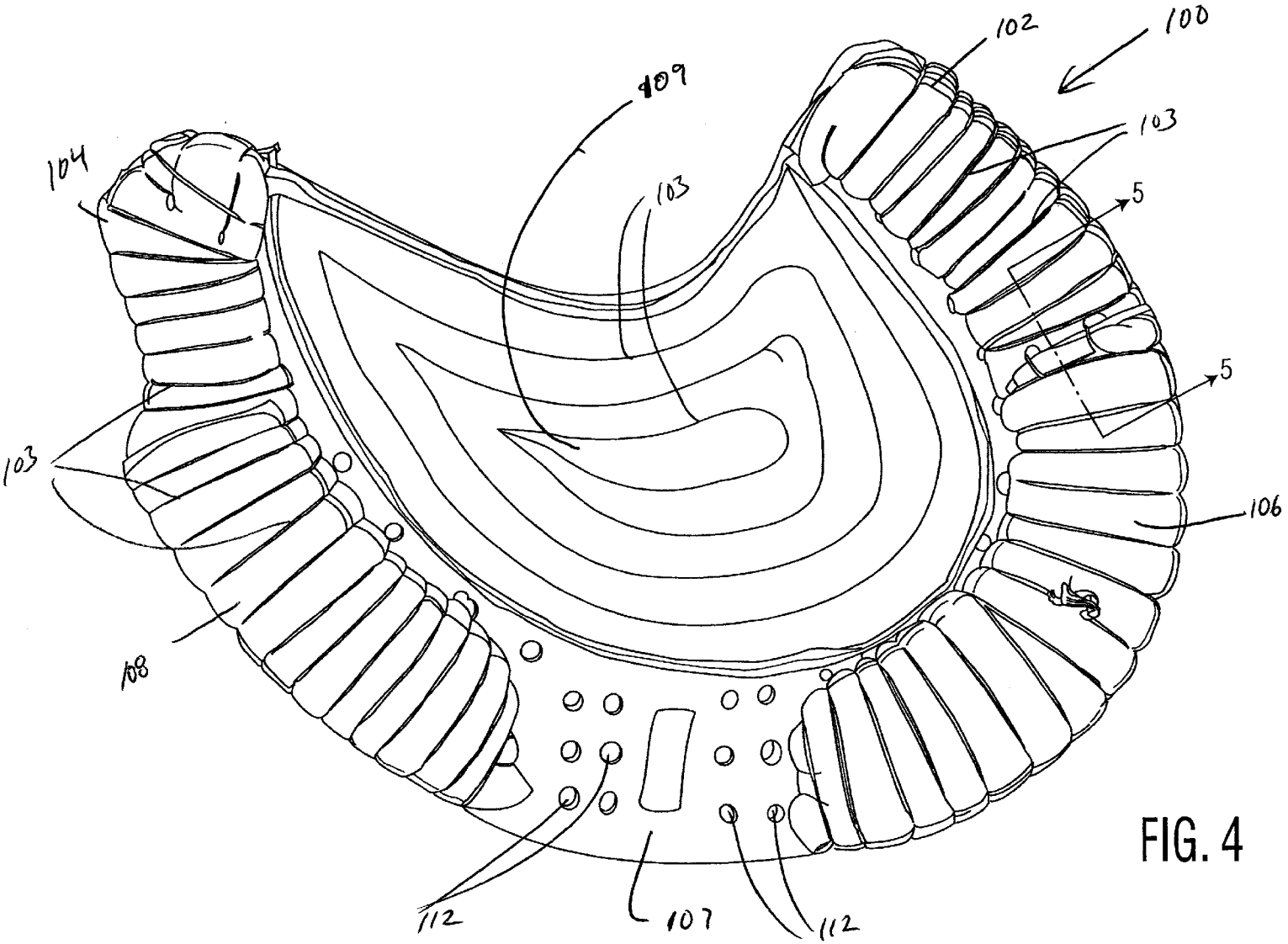
FIG. 4 is top plan view of the at least one padding member of the mitt of the subject invention.
Figure 5:
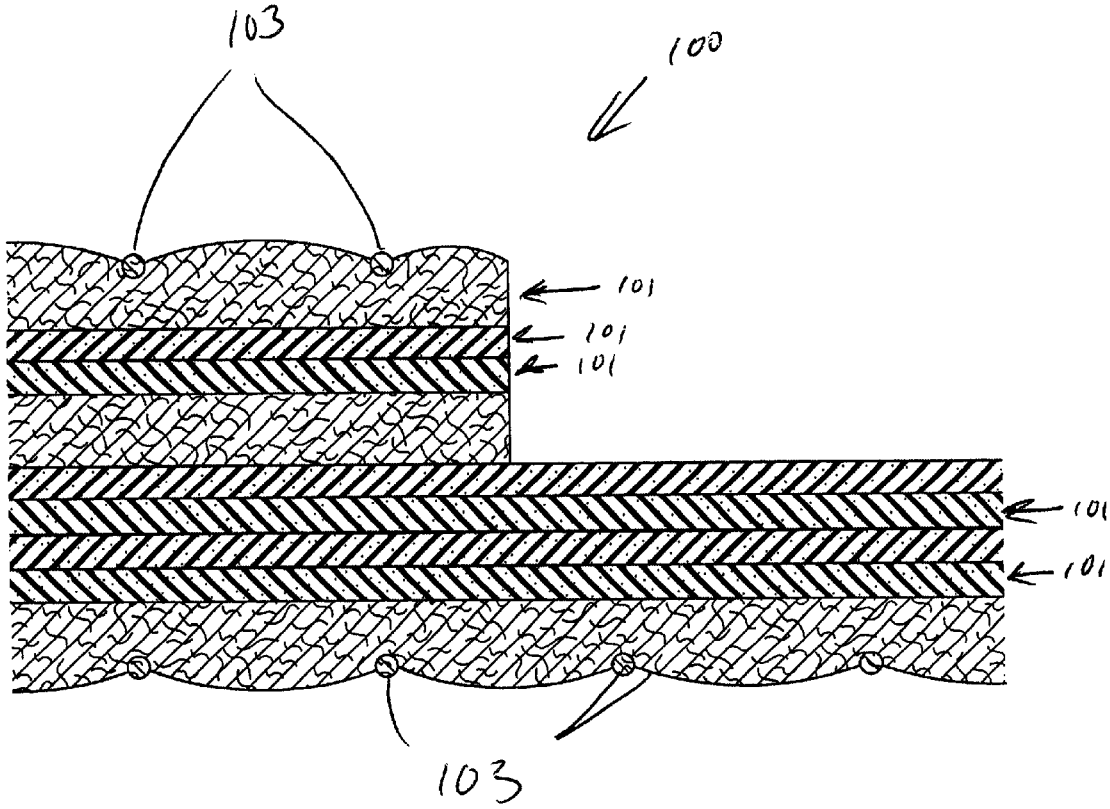
FIG. 5 is a cross-sectional view taken along line 4—4 of FIG. 4.

Turning now to FIG. 4, padding member 100 is seen. Cross-section 5—5 of FIG. 5 shows that padding member 100 is constructed of various layers 101 of padding materials to achieve the desired padding thickness at various portions of mitt 10. In particular, padding member 100 is seen to have six padding zones 102, 104, 106, 107, 108, and 109. When assembled, front shell 20 and back shell 30 of mitt 10 are attached together around padding member 100 in such a way so that zone 102 of padding member 100 is located at element 92 of FIG. 2, zone 104 is at element 94, zones 106 and 108 are at elements 96 and 98 and zones 107 and 109 of padding member 100 are at elements 97 and 99 of FIG. 2. In short, padding zones 102, 104, 106 and 108 are four peripheral padding zones for mitt 10, which extend out from and around padding zone 109. It is padding zone 109, along with web-type panel 70 that create pocket 12 of mitt 10; pocket 12 being defined as web-type panel 70 and element 99 of FIG. 2.

Defined by padding zones 106, 108 and 109, is padding zone 107, which corresponds in location to element 97 of FIG. 2, and heel portion 60 of mitt 10.

In the preferred embodiment, the thickness' of padding zones 106 and 108 are substantially the same, while the thickness' of padding zones 102 and 104 are substantially the same. However, padding zones 102 and 104 are intermediary in thickness to the thickness' of zones 109 and 106/108, with the lesser padding thickness being in zone 109 and the maximum padding thickness being in zones 106/108. This construction is best seen in the completed mitt of FIG. 2; where mitt 10 at 97 and 99 is least thick; where mitt 10 at 96 and 98 is thickest; and where mitt 10 at 92 and 94 is of medium thickness.

Accordingly, extending along the peripheries of mitt 10 in directions away from web-type panel 70, mitt 10 is seen to have padding zones which are substantially smaller in thickness than the padding zones which are peripherally located closer to heel portion 60. In practical application, these reduced padding zones near web-type panel 70 assist in the use of mitt 10 to easily and more securely catch a baseball that is inadvertently not centered within pocket 12 upon impact, but instead hits against either of zones 92 or 94. Since there is less padding in zones 92 and 94, there are also less angles between these areas of mitt 10 and pocket 12 of mitt 10; and less angles means less possibility of deflection of the ball in unforeseen and unwanted directions. Padding zones 106 and 108 are heavier in nature to protect the user's fingers and thumb from the impact of the ball; which can be thrown anywhere from 70 to 100+ miles per hour by a pitcher in a professional baseball game.

As is further seen if FIGS. 4 and 5, the layers of padding material of padding member 100 are held together by stitching 103. However, any known manner of holding layers of padding together can be used. The circular holes shown in FIG. 4, extend through padding member 100 for receipt therethrough of lacing 35 and 37, in order to assist holding shells 20 and 30 together, as has been previously discussed.

Figure 7:
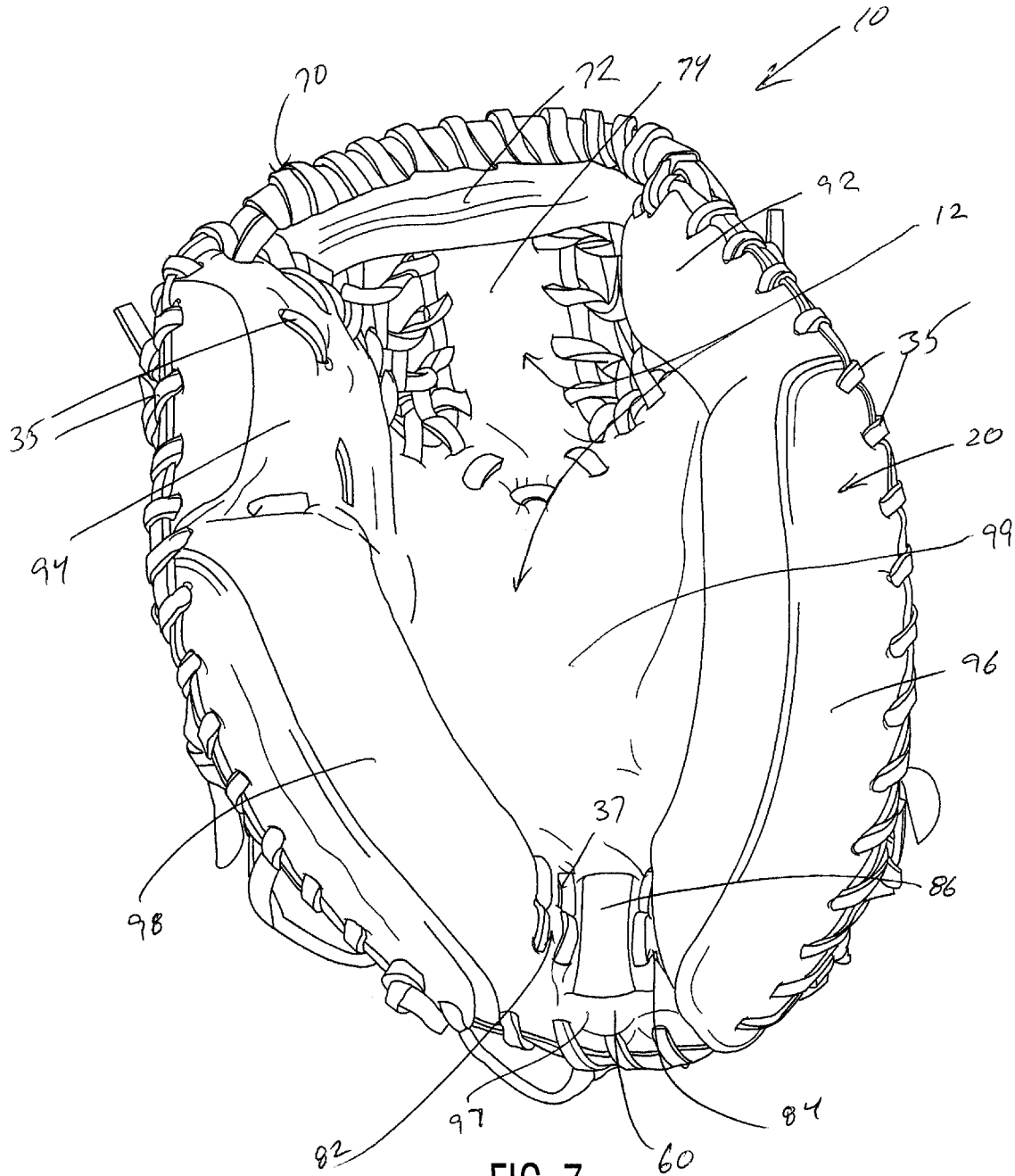
FIG. 7 is a front elevational view of a second embodiment of the baseball catcher's mitt of the subject invention, showing the extra padding at the heel portion of the mitt dividing the double hinge assembly.

Turning to a particular discussion of holes 112 of FIG. 4, it is seen in FIGS. 2 and 7 that lacing 37 and these holes 112 create a double-hinge assembly for mitt 10 that allows mitt 10 more flexibility in closing around a baseball received in pocket 12. In particular, hinge 82 and hinge 84 are formed between lacing 37.

In the embodiments of both FIGS. 2 and 7, it is seen that hinges 82 and 84 are separated by joint means 86. For the embodiment of FIG. 2, joint means 86 is an indented fold, while for the embodiment of FIG. 7, joint means 86 is a protruding padding element. Accordingly, joint means 86 separates hinges 82 and 84 in order to allow them the ability to more easily, and independently, perform their hinging function.

Figure 6:
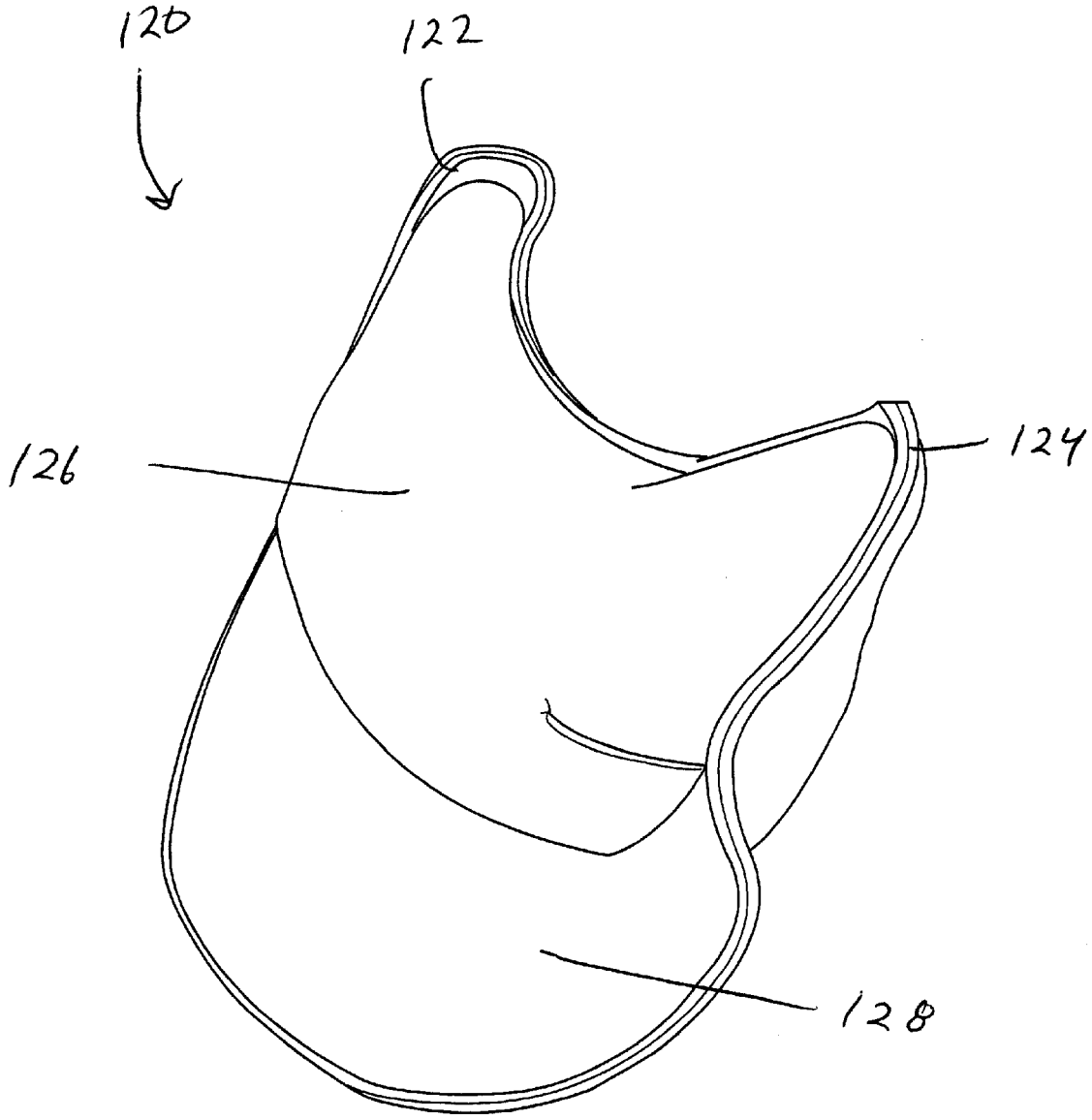
FIG. 6 is a perspective view of the stress wedge of the subject invention.

Finally, turning to FIG. 6, a stress wedge 120 is shown. Stress wedge 120 is situated within mitt 10 as best seen in FIG. 3, between back shell 30 and hand receiving assembly 40 in such a location as to provide padding for the soft web portion 130 of the user's hand located between the user's thumb and index finger and to provide extra padding to the remaining portion of the user's palm. Stress wedge 120 may either be non fixedly secured within hand receiving assembly 40, or may be fixedly attached depending upon the individual glove owner's preference. The thickest portion of stress wedge 120, bulbous member 126, directly cushions the web portion of the user's hand (as discussed above), along with a portion of the palm of the user's hand nearest the web portion, while a less bulbous flange member 128 of stress wedge 120 protects the remaining portion of the user's palm and a heel portion 132 of the user's hand further down along heel portion 60 of mitt 10.

Stress wedge 120 has two protruding elements 122 and 124 extending out from a bulbous member 126. Protruding elements 122 and 124 are situated so as to extend toward finger stall 46 and thumb stall 48, respectively, and as is best seen in FIG. 3. In this position, web portion 130 and that corresponding portion of the palm of the user's hand, will be against bulbous member 126 when stress wedge 120 and the user's hand are both in mitt 10. Further, and when in this position, any remaining, unprotected part of the palm of the user's hand, along with heel 132 of the user's hand, will be positioned against, and thereby at least partially protected by, less bulbous flange member 128 of stress wedge 120.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A baseball mitt, comprising:

a front shell having an edge;

a back shell having an edge, and being substantially joined to said front shell along select portions of said edges;

a web-type panel extending from said front and back shells, and being joined to said front and back shells along select portions of said panel and said shells, wherein said web-type panel and a substantially central portion of said front shell define a baseball receiving pocket of said mitt; and at least one padding member disposed between said front and back shells;

wherein said at least one padding member and said joined front and back shells, form at least four substantially peripheral and distinct padding zones of said mitt, each one extending outwardly from said pocket toward said edges of said shells, wherein two of said peripheral padding zones closest to, and on either side of, said web-type panel are greater in thickness then a thickness of said mitt at said pocket, but are lesser in thickness then a thickness of either of two other of said peripheral padding zones.

2. A baseball mitt as recited in claim 1, wherein said front and back shells are further substantially joined through select interior sections of said front shell, said back shell and said at least one padding member.

3. A baseball mitt as recited in claim 1, further comprising a substantially central padding zone for said pocket, formed by said at least one padding member and said joined front and back shells.

4. A baseball mitt as recited in claim 3, further comprising a heel portion of said mitt defined by said substantially central padding zone and said two other of said peripheral padding zones.

5. A baseball mitt as recited in claim 4, further comprising a padding zone for said heel portion, formed by said at least one padding member.

6. A baseball mitt as recited in claim 5, further comprising hinge means at said heel portion, for facilitating easier folding of said mitt around said baseball when said baseball is in said pocket of said mitt.

7. A baseball mitt as recited in claim 6, said hinge means comprising first and second hinge assemblies and joint means for facilitating a separation between said first and second hinge assemblies at said heel portion.

8. A baseball mitt as recited in claim 7, said joint means comprising a small portion of said at least one padding member at said padding zone for said heel portion being thicker then hinge portions of said at least one padding member at said padding zone for said heel portion located on either side of said small portion, wherein said first hinge assembly is located at a first of said hinge portions of said at least one padding member and said second hinge assembly is located at a second of said hinge portions of said at least one padding member.

9. A baseball mitt as recited in claim 8, wherein said small portion is substantially rectangular in shape.

10. A baseball mitt as recited in claim 7, said joint means comprising a substantially central indent in said padding zone at said heel portion, wherein said first and second hinge assemblies are located on either side of said indent.

11. A baseball mitt as recited in claim 7, further comprising finger stall means for receiving a hand of a user of said mitt, attached to an outer surface of said back shell.

12. A baseball mitt as recited in claim 11, said finger stall means comprising at least one finger stall and one thumb stall.

13. A baseball mitt as recited in claim 12, said at least one finger stall having at least two finger hammocks for receipt therein of at least two fingers of said hand of said user and said thumb stall having another finger hammock for receipt of a thumb of said hand of said user.

14. A baseball mitt as recited in claim 13, said at least two finger hammocks comprising three finger hammocks for receipt therein of a pinky finger, a ring finger and a middle finger of said hand of said user.

15. A baseball mitt as recited in claim 12, said at least one finger stall comprising three finger stalls for receipt therein of a pinky finger, a ring finger, a middle finger and an index finger of said hand of said user.

16. A baseball mitt as recited in claim 15, said three finger stalls comprising three finger hammocks for receipt therein of said pinky finger, said ring finger and said middle finger of said hand of said user.

17. A baseball mitt as recited in claim 12, further comprising stress wedge means for cushioning the impact of said baseball against said hand of said user, said stress wedge means attached to said mitt between said at least one finger stall and said thumb stall for receipt thereagainst of a portion of said hand of said user between an index finger and a thumb of said hand.

18. A baseball mitt as recited in claim 17, said stress wedge means comprising a substantially bulbous padding member.

19. A baseball mitt as recited in claim 17, said stress wedge means attached to said mitt along an outer surface of said back shell.

20. A baseball mitt, comprising:

a front shell having an edge;

a back shell having an edge, and being substantially joined to said front shell along select portions of said edges;

a web-type panel extending -from said front and back shells, and being joined to said front and back shells along select portions of said panel and said shells, wherein said web-type panel and a substantially central portion of said front shell define a baseball receiving pocket of said mitt;

at least one padding member disposed between said front and back shells, wherein said at least one padding member and said joined front and back shells, form four substantially peripheral padding zones of said mitt, each one extending outwardly from said pocket toward said edges of said shells, wherein two of said peripheral padding zones closest to, and on either side of, said web-type panel are greater in thickness then a thickness of said mitt at said pocket, but are lesser in thickness then a thickness of either of two other of said peripheral padding zones;

a substantially central padding zone for said pocket, formed by said at least one padding member and said joined front and back shells;

a heel portion of said mitt having a padding zone, defined by said substantially central padding zone and said two other of said peripheral padding zones; and first and second hinge assemblies, and joint means for facilitating a separation between said first and second hinge assemblies, at said heel portion, for facilitating easier folding of said mitt around said baseball when said baseball is in said pocket of said mitt.

21. A baseball mitt, comprising:

a front shell having an edge;

a back shell having an edge, and being substantially joined to said front shell along select portions of said edges;

a web-type panel extending from said front and back shells, and being joined to said front and back shells along select portions of said panel and said shells, wherein said web-type panel and a substantially central portion of said front shell define a baseball receiving pocket of said mitt;

at least one padding member disposed between said front and back shells, wherein said at least one padding member and said joined front and back shells, form four substantially peripheral padding zones of said mitt, each one extending outwardly from said pocket toward said edges of said shells, wherein two of said peripheral padding zones closest to, and on either side of, said web-type panel are greater in thickness then a thickness of said mitt at said pocket, but are lesser in thickness then a thickness of either of two other of said peripheral padding zones; and finger stall means attached to an outer surface of said back shell for receiving a hand of a user of said mitt, comprising at least one finger stall and one thumb stall, said at least one finger stall having at least two finger hammocks for receipt therein of at least two fingers of said hand of said user and said thumb stall having another finger hammock for receipt of a thumb of said hand of said user.

22. A baseball mitt, comprising:

a front shell having an edge;

a back shell having an edge, and being substantially joined to said front shell along select portions of said edges;

a web-type panel extending from said front and back shells, and being joined to said front and back shells along select portions of said panel and said shells, wherein said web-type panel and a substantially central portion of said front shell define a baseball receiving pocket of said mitt;

at least one padding member disposed between said front and back shells, wherein said at least one padding member and said joined front and back shells, form four substantially peripheral padding zones of said mitt, each one extending outwardly from said pocket toward said edges of said shells, wherein two of said peripheral padding zones closest to, and on either side of, said web-type panel are greater in thickness then a thickness of said mitt at said pocket, but are lesser in thickness then a thickness of either of two other of said peripheral padding zones;

finger stall means attached to an outer surface of said back shell for receiving a hand of a user of said mitt, comprising at least one finger stall and one thumb stall, said at least one finger stall having at least two finger hammocks for receipt therein of at least two fingers of said hand of said user and said thumb stall having another finger hammock for receipt of a thumb of said hand of said user; and stress wedge means for cushioning the impact of said baseball against said hand of said user, said stress wedge means attached to said mitt between said at least one finger stall and said thumb stall for receipt thereagainst of a portion of said hand of said user between an index finger and a thumb of said hand.

23. A baseball mitt, comprising:

a front shell having an edge;

a back shell having an edge, and being substantially joined to said front shell along select portions of said edges;

a web-type panel extending from said front and back shells, and being joined to said front and back shells along select portions of said panel and said shells;

at least one padding member disposed between said front and back shells;

finger stall means for receiving a hand of a user of said mitt, comprising at least one finger stall and one thumb stall; and stress wedge means for cushioning the impact of a baseball against said hand of said user, located within said finger stall means between said at least one finger stall and said thumb stall, comprising a first substantially bulbous padding member for receipt thereagainst of a portion of said hand of said user between an index finger and a thumb of said hand and a second flange member for receipt thereagainst of the remainder of a palm of said hand of said user, wherein said bulbous padding member has a greater pad thickness then said flange member.

24. A baseball mitt as recited in claim 23, said stress wedge means attached to said mitt along an outer surface of said back shell.

25. A baseball mitt as recited in claim 23, wherein said web-type panel and a substantially central portion of said front shell define a baseball receiving pocket of said mitt.

26. A baseball mitt as recited in claim 25, wherein said at least one padding member and said joined front and back shells, form four substantially peripheral padding zones of said mitt, each one extending outwardly from said pocket toward said edges of said shells, wherein two of said peripheral padding zones closest to, and on either side of, said web-type panel are greater in thickness then a thickness of said mitt at said pocket, but are lesser in thickness then a thickness of either of two other of said peripheral padding zones.

27. A baseball mitt as recited in claim 26, further comprising a substantially central padding zone for said pocket, formed by said at least one padding member and said joined front and back shells.

28. A baseball mitt as recited in claim 27, further comprising a heel portion of said mitt defined by said substantially central padding zone and said two other of said peripheral padding zones.

29. A baseball mitt as recited in claim 28, further comprising a padding zone for said heel portion, formed by said at least one padding member.

30. A baseball mitt as recited in claim 29, further comprising hinge means at said heel portion, for facilitating easier folding of said mitt around said baseball when said baseball is in said pocket of said mitt.

31. A baseball mitt as recited in claim 30, said hinge means comprising first and second hinge assemblies and joint means for facilitating a separation between said first and second hinge assemblies at said heel portion.

32. A baseball mitt as recited in claim 31, said joint means comprising a small portion of said at least one padding member at said padding zone for said heel portion being thicker then hinge portions of said at least one padding member at said padding zone for said heel portion located on either side of said small portion, wherein said first hinge assembly is located at a first of said hinge portions of said at least one padding member and said second hinge assembly is located at a second of said hinge portions of said at least one padding member.

33. A baseball mitt as recited in claim 32, wherein said small portion is substantially rectangular in shape.

34. A baseball mitt as recited in claim 31, said joint means comprising a substantially central indent in said padding zone at said heel portion, wherein said first and second hinge assemblies are located on either side of said indent.

35. A baseball mitt as recited in claim 34, said indent defined by a hole in said at least one padding member and said front shell, at said heel portion.

36. A baseball mitt as recited in claim 23, said at least one finger stall having at least two finger hammocks for receipt therein of at least two fingers of said hand of said user and said thumb stall having another finger hammock for receipt of a thumb of said hand of said user.

37. A baseball mitt as recited in claim 36, said at least two finger hammocks comprising three finger hammocks for receipt therein of a pinky finger, a ring finger and a middle finger of said hand of said user.

38. A baseball mitt as recited in claim 23, said at least one finger stall comprising three finger stalls for receipt therein of a pinky finger, a ring finger, a middle finger and an index finger of said hand of said user.

39. A baseball mitt as recited in claim 38, said three finger stalls comprising three finger hammocks for receipt therein of said pinky finger, said ring finger and said middle finger of said hand of said user.

40. A padding assembly for a baseball glove/mitt, to be fit within said glove/mitt between an index finger stall and a thumb stall of said glove/mitt, comprising:

a first bulbous member for padding a hand of a user of said glove/mitt between a thumb and an index finger of said hand, including a portion of a palm of said hand; and a second less bulbous flange member extending from said bulbous member for padding a remaining portion of said palm of said hand and a heel portion of said hand below said palm.

41. A padding assembly as recited in claim 40, further comprising two protruding elements, one protruding toward said finger stall and another protruding toward said thumb stall, located substantially opposite to said second less bulbous flange member.

42. A baseball mitt, comprising:

a front shell having an edge;

a back shell having an edge, and being substantially joined to said front shell along select portions of said edges;

a web-type panel extending from said front and back shells, and being joined to said front and back shells along select portions of said panel and said shells;

finger stall means for receiving a hand of a user of said mitt, comprising at least one finger stall and one thumb stall; and stress wedge means for cushioning the impact of a baseball against said hand of said user, located within said finger stall means between said at least one finger stall and said thumb stall, comprising a first, substantially bulbous padding, member for receipt thereagainst of a first portion of said hand of said user between an index finger and a thumb of said hand and a second, flange, member extending from said bulbous padding member for receipt thereagainst of a second, palm, portion of said hand of said user, wherein said bulbous padding member has a greater pad thickness then said flange member.

43. A padding assembly for a baseball glove/mitt, to be fit within said glove/mitt between an index finger stall and a thumb stall of said glove/mitt and touching portions of a thumb and an index finger of a user of said glove/mitt comprising:

a first bulbous member for padding a hand of said user of said glove/mitt between said thumb and said index finger of said hand, including a portion of a palm of said hand; and a second less bulbous flange member extending from said first bulbous member for padding more of said palm of said user's hand.

* * * * *